US011273655B2

(12) United States Patent
Palumbo

(10) Patent No.: US 11,273,655 B2
(45) Date of Patent: Mar. 15, 2022

(54) DIGITAL PRINTING DEVICE COMPRISING A PRINT MEDIA ADVANCEMENT SYSTEM

(71) Applicant: NEOS S.r.l., Fiorano Modenese (IT)

(72) Inventor: Vincenzo Palumbo, Fiorano Modenese (IT)

(73) Assignee: NEOS S.r.l., Fiorano Modenese (IT)

( * ) Notice: Subject to any disclaimer, the term of this patent is extended or adjusted under 35 U.S.C. 154(b) by 0 days.

(21) Appl. No.: 17/297,883

(22) PCT Filed: Nov. 27, 2019

(86) PCT No.: PCT/EP2019/082770

§ 371 (c)(1),
(2) Date: May 27, 2021

(87) PCT Pub. No.: WO2020/109402

PCT Pub. Date: Jun. 4, 2020

(65) Prior Publication Data

US 2021/0354487 A1 Nov. 18, 2021

(30) Foreign Application Priority Data

Nov. 28, 2018 (EP) ..... 18425088

(51) Int. Cl.
*B41J 15/04* (2006.01)
*B41J 11/00* (2006.01)

(52) U.S. Cl.
CPC ..... *B41J 15/046* (2013.01); *B41J 11/0085* (2013.01); *B41J 15/048* (2013.01); *B65H 2406/112* (2013.01); *B65H 2406/364* (2013.01)

(58) Field of Classification Search
CPC .... B41J 15/046; B41J 11/0085; B41J 15/048; B65H 2406/112; B65H 2406/364
See application file for complete search history.

(56) References Cited

U.S. PATENT DOCUMENTS 3,678,599 A * 7/1972 Vits ..... B65H 23/24 34/641
2013/0108790 A1* 5/2013 Dehn ..... B41J 25/312 427/256

OTHER PUBLICATIONS

Written Opinion of the International Searching Authority issued in connection with PCT/EP2019/082770.
International Search Report issued in connection with PCT/EP2019/082770.

* cited by examiner

*Primary Examiner* — Henok D Legesse
(74) *Attorney, Agent, or Firm* — Akerman LLP

(57) ABSTRACT

Digital printing device having a print media advancement system, and comprising: a sliding surface (3) of the print media, arranged at a printing area with above a printing module of the digital printing device; means for dragging (4) the print media, arranged downstream and/or upstream the printing area and arranged to make the print media advance in an advancement direction (x) above said sliding surface (3); wherein said sliding surface (3) comprises blowing portions (35) destined to realize an air cushion between sliding surface and print media (100). The sliding surface further comprises at least a suction portion (30), arranged to realise a depression by locally putting the print media near said sliding surface.

13 Claims, 3 Drawing Sheets

DIGITAL PRINTING DEVICE COMPRISING A PRINT MEDIA ADVANCEMENT SYSTEM

CROSS-REFERENCE TO RELATED APPLICATIONS

This application is a national phase of PCT/EP2019/082770, filed Nov. 27, 2019, and claims priority to EP18425088.4, filed Nov. 28, 2018, the entire contents of both of which are hereby incorporated by reference.

TECHNICAL FIELD

The present invention relates to a digital printing device comprising a print media advancement system.

In particular, the advancement system according to the present invention appears to be particularly suitable for relatively deformable media that can be reeled, such as paper or plastic film.

The invention can, in particular, find useful application in multiple technological sectors where industrial printing is required, in particular on the two surfaces previously identified.

BACKGROUND ART

In industrial printing devices the controlled and precise advancement of the print media below the printing module has to be guaranteed during operation.

Such requirement is difficult to meet in the case of flexible and relatively deformable print media, such as paper or plastic film. In this case, not only is it necessary that the dragging occurs at the desired speed, but it is also important that the media is kept outstretched during the printing operations, avoiding folds or creases which would determine local printing errors.

The systems known to date employ a roller or a humpback element on which the print media is made to slide, appropriately dragged by a pair of rollers, one of which is motorized, known in the sector as nip rolls.

Such systems, however, still appear to be perfectible; in particular, the sliding of the print media is difficult, giving place to non-uniform local tensions, above all at high print speeds.

The performances appear to be unacceptable for high quality prints when the print speed exceeds certain thresholds, indicatively 80 meters a minute for large format paper media.

Further, the humpback conformation of the print surface forces to put the different heads of the printing module as near as possible; a planar print surface, instead, would allow an easier and more efficient design of the printing device.

In particular, the arrangement of print heads on a curved surface, apart from demanding per se a complicated mechanical design, implies a difficulty for cleaning the heads themselves, forcing the use of elaborated and expensive cleaning systems for keeping a good printing quality.

A print media advancement system according to the prior art is shown in prior art document US 2013/108790 A1. A fluidized bed for drying a printed web is shown in U.S. Pat. No. 3,678,599 A.

The technical problem at the basis of the present invention is therefore that of solving the inconveniences encountered in the paper advancement systems known to date, in particular allowing a constant tension of the print media also at high speeds.

DISCLOSURE OF INVENTION

The technical problem previously identified is solved by a print media advancement system for digital printing device, comprising:

a sliding surface of the print media, arranged at a printing area with above a printing module of the digital printing device;

means for dragging the print media, placed downstream and/or upstream a printing area and arranged to make the print media advance in an advancement direction (x) above said sliding surface;

wherein said sliding surface comprises at least a blowing portion arranged to realize an air cushion between said sliding surface and said print media.

The presence of an air cushion between print surface and media facilitates the sliding of the media itself, avoiding the formation of folds and creases and keeping the pull tension constant.

The sliding surface further comprises at least a suction portion, arranged to realize a depression by locally putting the print media near said sliding surface.

Preferably, the depression created on the suction portion puts the print media near the sliding surface without making the media adhere to the surface, so as to avoid undesired local friction.

In particular, the suction portions and the blowing portions can have a plurality, alternated along the advancement direction.

In this way, the print media is locally tightened by the suction portions, while the blowing portions provide for the stretching thereof between two subsequent suction portions, guaranteeing the total absence of folds or creases.

Advantageously, when coupled to a printing device, the different print heads will be overlapped to respective blowing portions, so as to release ink on the conveniently stretched media.

The suction portions can comprise first plates traversed by suction openings, at least a suction fan being arranged to realize a depression below said first plates, preferably in a depression chamber.

The blowing portions, instead, can comprise second plates, below which blowing means are operating which can advantageously be realized in a compressed air circuit. Below the second plates is therefore created a pressurized chamber.

The second plates are preferably realized in a porous material, so as to avoid the presence of macroscopic holes that would determine localized deformations of the print media. The material, for example, can be a porous aluminum, realized with aluminum powders and special epoxy resins, sold under the commercial name of Metapor®.

The material of the first plates does not have to have necessarily the same characteristics as that of the second plates, since the printing directly above is not provided for. The first plates can therefore be realized in steel, for example, with holes or cracks for the passage of the air.

Preferably, the power of the suction means and the power of the blowing means can be both adjusted, also independently, to adapt the advancement system to different print media.

The means for dragging can comprise a vacuum belt conveyor, arranged to bear the print media downstream said sliding surface and drag it according to the advancement direction.

It is noted that, thanks to the characteristics of the invention, the sliding surface can be flat, namely it does not have to be necessarily humpback-shaped, as in the devices of the background art.

The choice of a vacuum belt conveyor appears to be particularly advantageous, since it allows to exert a pull action without entering into contact with the superior face of the print media, on which ink is released. The vacuum belt conveyor can therefore be positioned immediately downstream the sliding surface, unlike the nip rolls that have to be placed at a sufficient distance to allow the drying of ink. This results in a more homogeneous tension of the print media.

The vacuum belt conveyor is realized in the form of a perforated belt wound up between two rollers, wherein suction means are arranged below said perforated belt.

The means for dragging can further comprise a pair of nip rolls arranged upstream said sliding surface to drag the print media in the advancement direction, a first motor for the activation of said nip rolls and a second motor for the activation of said suctioned belt being synchronized with one another.

The vacuum belt conveyor can be mounted on a sled transversally mobile with respect to the advancement direction for transversally aligning the print media with respect to the printing module of the printing device.

In particular, on one side a sensor, preferably a fork-shaped one, to acquire a transversal position of the print media on the vacuum belt, conveyor on the other side a linear actuator for the transversal positioning of the sled on the basis of the reading of said sensor, can be provided for.

The print media is preferably a print media that can be reeled, for example paper or plastic film.

The means for dragging can comprise in this case at least an unwinding roller, arranged upstream the sliding surface, and a winding roller, arranged downstream the sliding surface.

The technical problem previously identified is therefore solved by a digital printing device comprising an advancement system as previously described, wherein said digital printing device comprises a printing module that is above said sliding surface.

As previously mentioned, the print heads of the digital printing device will preferably be positioned above the blowing portions of the sliding surface.

Further features and advantages will become more apparent from the detailed description made below of a preferred non-limiting embodiment of the present invention, with reference to the annexed figures, given for illustrating but not limiting purposes.

MODES FOR CARRYING OUT THE INVENTION

Figure 1:
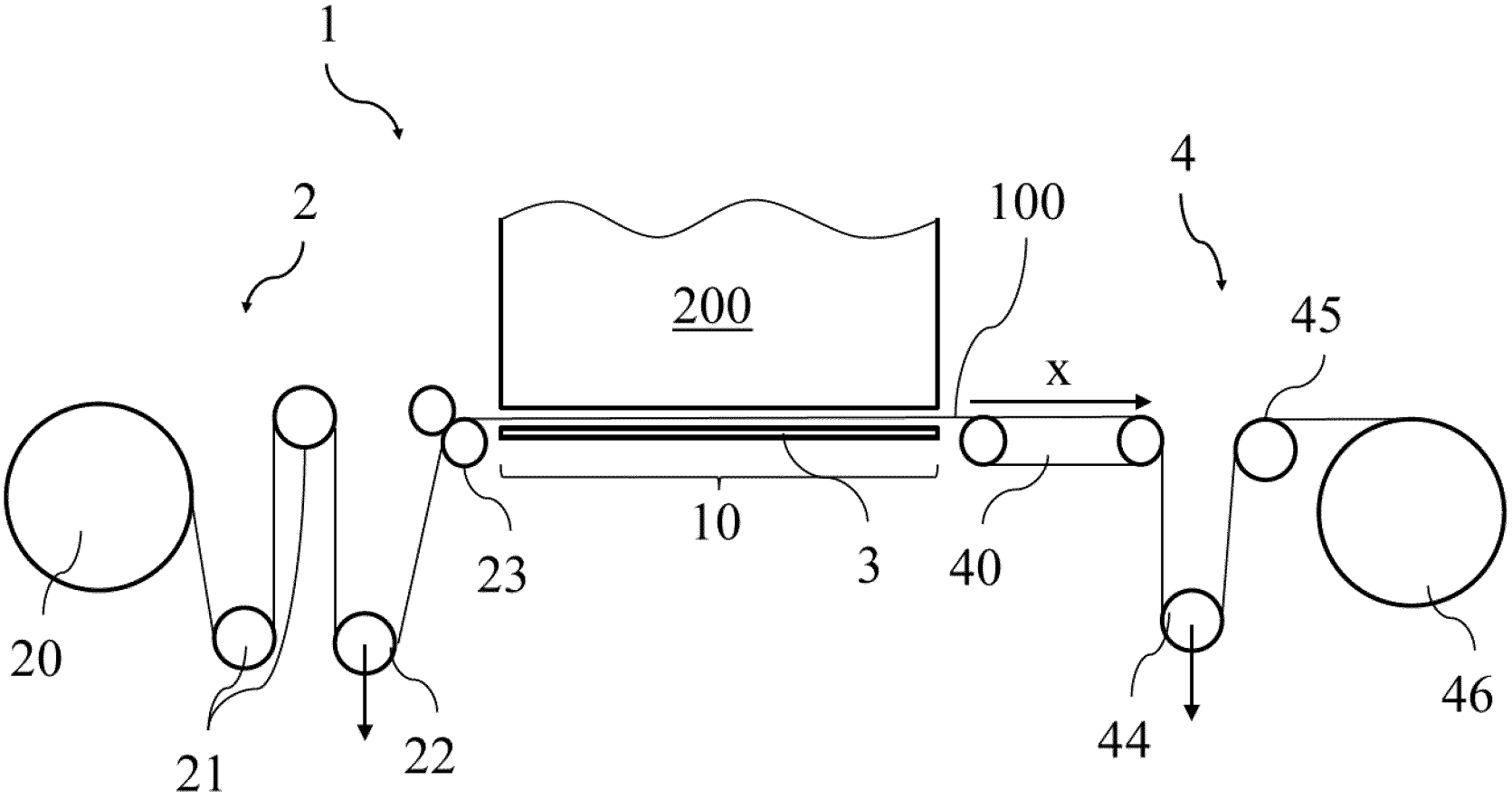
FIG. 1 shows a general scheme of a print media advancement system according to the present invention.

With reference to the annexed FIG. 1, we generically identify with 1 a print media advancement system for digital printing device according to the present invention.

We note that such advancement system 1 is generally integrated in a digital printing device, namely in a device arranged for the digital printing of a print media.

Such printing device, known per se, preferably comprises a fixed bridge under which the print media is dragged, which can be of any nature. One or more print heads, mounted on a printing module 200, provide for the delivery of ink on the print media that transits under them, realizing an image, a motif, a decoration, or any graphic element desired.

The advancement system 1, arranged in particular to move a paper or plastic film media, provides for an upstream unwinding roller 20 for the supply of the print media 100.

The print media 100, in a manner known per se, coming out from the unwinding roller 20 winds on a pair of rewind assist rollers 21, therefore on a compensator roller 22, to be then taken by a pair of nip rolls 23, one of which is motorized.

At this point, in the device of the present invention the print media 100 moves, along an advancement direction x, on a sliding surface 3 corresponding to a printing area 10. In this area, in fact, the printing module 200 of the digital printing device is above the media 100, delivering the quantity of ink necessary for the realization of the desired graphic element.

At the exit of the printing area 10 the print media 100 is born by a vacuum belt conveyor 40, followed by a stretching roller 44, a last rewind assist roller 45, last, a winding roller 46.

The electric motor 41 that activates the vacuum belt 40 is synchronized to the one that moves the nip rolls 23, so as to guarantee a homogeneous advancement of the whole print media 100.

In particular, the combined action of the nip rolls 23 and of the vacuum belt 40 defines a homogeneous tension of the print media among such organs, namely along the whole printing area 10.

Figure 2:
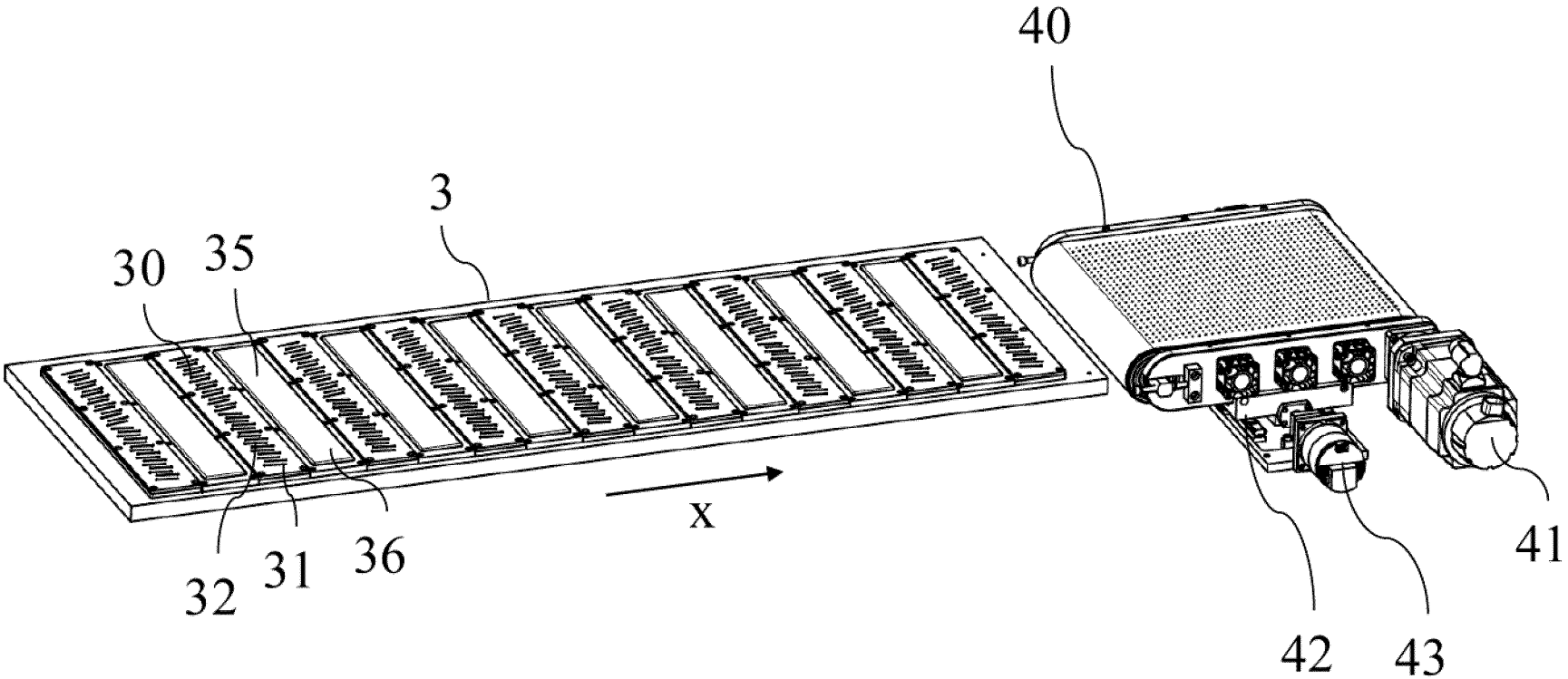
FIG. 2 shows a perspective view of two prominent elements, a sliding bed defining a sliding surface and a vacuum belt conveyor, of the advancement system of figure.
Figure 3:
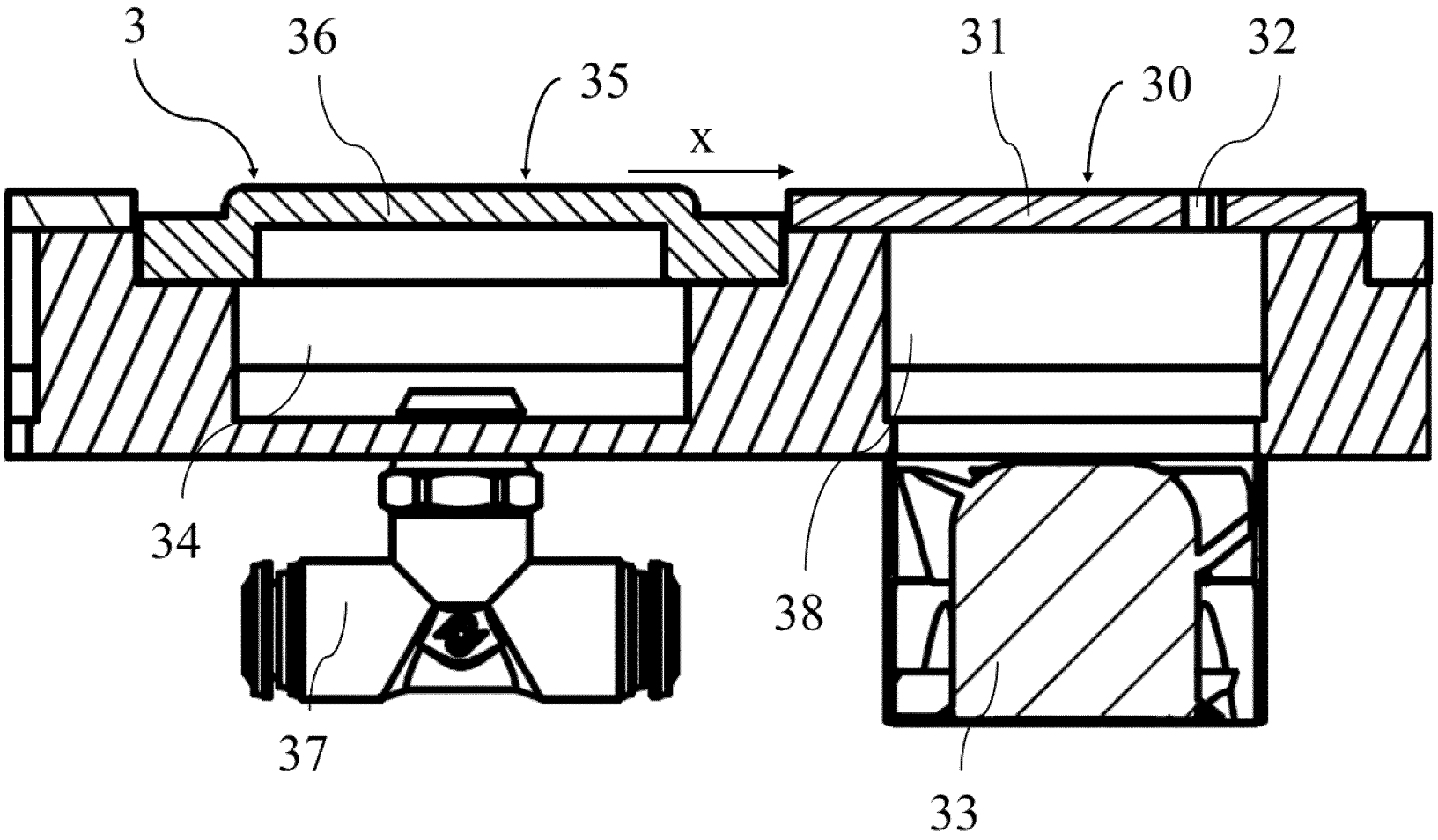
FIG. 3 shows a transversal section of the sliding bed of FIG. 2.

The sliding surface 3, in this particular case flat, is defined by the superior surface of a bed represented in a detailed manner in FIGS. 2 and 3.

The sliding surface 3 exhibits suction portions 30 alternated with blowing portions 35.

The suction portions 30 are defined superiorly by first plates 31, preferably of steel, which close transversal depression chambers 38 realized in the bed. The depression chambers 38 are kept in depression by means of one or more suction fans 33, arranged at an inferior outlet. The first plates 31 provide for suction openings 32, in particular cracks, which put in communication the depression chamber 38 and the above sliding surface 3.

The suction portions 30 suck up the print media 100, thus locally bringing it near the sliding surface 3 but without making the media adhere to the surface.

The blowing portions 35 are defined superiorly by second plates 36, preferably of porous aluminum, which close transversal pressurized chambers 34 realized between a depression chamber 38 and the other one. The pressurized chambers 38 receive compressed air from an underlying compressed air circuit 37.

The air passes through the second porous plate and realizes a fluid bed that lifts and stretches the print media 100 between two subsequent suction portions 30.

Thus, the alternation of suction portions 30 and blowing portions 35 advantageously allows to locally stretch the print media, in particular at the print heads that rest on the blowing portions 35.

Different power adjustments for suction and blowing allow to adapt the sliding bed to different print media 100.

The vacuum belt conveyor 40 is mounted on a sled 42, mobile in transversal direction with respect to the advancement direction x as a result of a linear actuator 43. A fork-shaped sensor, mounted on the opposite side with respect to the linear actuator 43 and not represented in the annexed figures, allows the reading of the linear position of the print media 100 and eventually corrections in case of missing alignment with respect to the printing module 200.

Naturally, to the description made here, in order to satisfy contingent and specific needs, a skilled person will be able to devise further modifications and variants, all however contained in the scope of protection of the invention as defined by the following claims.

What is claimed is:

1. A digital printing device comprising a print media advancement system and a printing module, said print media advancement system comprising:

a sliding surface of the print media, arranged at a printing area with above the printing module;

means for dragging the print media, placed downstream and/or upstream the printing area and arranged to make the print media advance in an advancement direction above said sliding surface;

said printing module being above said sliding surface;

wherein said sliding surface comprises at least a blowing portion, arranged to realize an air cushion between said sliding surface and said print media, and at least a suction portion, arranged to realize a depression thus locally bringing the print media near said sliding surface.

2. The digital printing device according to claim 1, wherein said suction portions and said blowing portions are a plurality, alternated along the advancement direction.

3. The digital printing device according to claim 1, wherein said suction portions comprise first plates traversed by suction openings, at least a suction fan being arranged to realize a depression below said first plates.

4. The digital printing device according to claim 1, wherein said blowing portions comprise second plates below which blowing means are operating.

5. The digital printing device according to claim 4, wherein said second plates are realized in a porous material.

6. The digital printing device according to claim 1, wherein said sliding surface is a flat surface.

7. The digital printing device according to claim 1, wherein said suction portions comprise suction means and said blowing portions comprise blowing means, the suction means and the blowing means being independently adjustable from one another.

8. The digital printing device according to claim 1, wherein said means for dragging comprise a vacuum belt conveyor, arranged to bear the print media downstream said sliding surface and drag it according to the advancement direction.

9. The digital printing device according to claim 8, wherein said vacuum belt conveyor is realized in the form of a perforated belt wound up between two rollers, suction means being arranged below said perforated belt.

10. The digital printing device according to claim 8, wherein said means for dragging further comprise a pair of nip rolls arranged upstream said sliding surface to drag the print media in the advancement direction, a first motor for the activation of said nip rolls and a second motor for the activation of said belt vacuum being synchronized with one another.

11. The digital printing device according to claim 8, wherein said vacuum belt conveyor is mounted on a sled transversally mobile with respect to the advancement direction for controlling the transversal position of the print media with respect to the printing module of the printing device.

12. The digital printing device according to claim 11, further comprising a sensor to acquire a transversal position of the print media on the sled and a linear actuator for the transversal positioning of the sled activated on the basis of the reading of said sensor.

13. The digital printing device according to claim 1, wherein said print media is a print media that can be reeled, for example paper or plastic, said means for dragging comprising at least an unwinding roller arranged upstream the sliding surface and a winding roller arranged downstream the sliding surface.

* * * * *